US011698211B2

(12) United States Patent
Jung et al.

(10) Patent No.: US 11,698,211 B2
(45) **Date of Patent: *Jul. 11, 2023**

(54) REFRIGERATOR WITH VACUUM INSULATION HOUSING A HEAT INTERCHANGER

(71) Applicant: LG ELECTRONICS INC., Seoul (KR)

(72) Inventors: Wonyeong Jung, Seoul (KR); Deokhyun Youn, Seoul (KR)

(73) Assignee: LG Electronics Inc., Seoul (KR)

( * ) Notice: Subject to any disclaimer, the term of this patent is extended or adjusted under 35 U.S.C. 154(b) by 17 days.

This patent is subject to a terminal disclaimer.

(21) Appl. No.: 16/298,281

(22) Filed: Mar. 11, 2019

(65) Prior Publication Data

US 2019/0203986 A1 Jul. 4, 2019

Related U.S. Application Data

(63) Continuation of application No. 15/182,652, filed on Jun. 15, 2016, now Pat. No. 10,228,169, which is a (Continued)

(30) Foreign Application Priority Data

Nov. 4, 2011 (KR) ..... 10-2011-0114571

(51) Int. Cl.
*F25D 23/06* (2006.01)
*F25B 40/00* (2006.01)

(52) U.S. Cl.
CPC ..... *F25B 40/00* (2013.01); *F25D 23/061* (2013.01); *F25D 23/067* (2013.01); *F25D 2201/14* (2013.01)

(58) Field of Classification Search
CPC ..... F25D 23/061; F25D 2201/14; F25B 2400/052; F25B 2400/054
See application file for complete search history.

(56) References Cited

U.S. PATENT DOCUMENTS 1,518,668 A 12/1924 Mitchell
1,541,945 A 6/1925 Hamilton
(Continued)

FOREIGN PATENT DOCUMENTS

CN 85106738 6/1986
CN 2033487 3/1989
(Continued)

OTHER PUBLICATIONS

U.S. Office Action dated Jan. 28, 2014 for U.S. Appl. No. 13/654,566, 18 pages.
(Continued)

*Primary Examiner* — Christopher R Zerphey
(74) *Attorney, Agent, or Firm* — Fish & Richardson P.C.

(57) ABSTRACT

A refrigerator includes an inner case, an outer case, a vacuum space, and a liquid-gas interchanger. The inner case defines an exterior appearance of a storage space. The outer case is spaced apart a predetermined distance from the inner case. The vacuum space is provided between the inner case and the outer case, and maintains a vacuum to insulate the inner case from the outer case. The liquid-gas interchanger is arranged in the vacuum space to generate heat exchange between a refrigerant after it is exhausted from an evaporator and a refrigerant before it is drawn into an evaporator.

22 Claims, 5 Drawing Sheets

Related U.S. Application Data continuation of application No. 13/655,677, filed on Oct. 19, 2012, now Pat. No. 9,377,227.

(56) References Cited

U.S. PATENT DOCUMENTS

| | | | | |
|---|---|---|---|---|
| 1,561,769 | A * | 11/1925 | Ballew | A47J 41/022 220/592.05 |
| 1,588,707 | A | 6/1926 | Alexander | |
| 1,747,969 | A | 2/1930 | Carrey | |
| 1,770,200 | A | 7/1930 | Comstock | |
| 1,814,114 | A * | 7/1931 | Bodman | F25D 3/102 62/231 |
| 1,833,633 | A | 11/1931 | Bodman | |
| 2,000,882 | A * | 5/1935 | Comstock | F25D 23/062 220/592.26 |
| 2,044,600 | A | 6/1936 | Williams | |
| 2,065,608 | A | 12/1936 | Georg | |
| 2,181,856 | A * | 11/1939 | McCloy | F25B 41/067 62/452 |
| 2,196,373 | A | 4/1940 | Wallach | |
| 2,487,662 | A | 11/1949 | McCloy | |
| 2,487,791 | A | 11/1949 | Coons | |
| 2,553,693 | A * | 5/1951 | Wehr | F25D 23/061 62/339 |
| 2,581,044 | A | 1/1952 | Ratcliff | |
| 2,753,695 | A * | 7/1956 | Maranto | F25D 19/00 62/448 |
| 2,773,362 | A | 12/1956 | Scheitlin | |
| 2,867,417 | A | 1/1959 | Axel | |
| 3,003,333 | A * | 10/1961 | Lysen | F25D 11/022 62/199 |
| 3,161,265 | A * | 12/1964 | Matsch | E04B 1/803 52/788.1 |
| 3,955,374 | A | 5/1976 | Zearfoss, Jr. | |
| 4,036,617 | A | 7/1977 | Leonard et al. | |
| 4,147,037 | A | 4/1979 | Gelbard et al. | |
| 4,301,658 | A | 11/1981 | Reed | |
| 4,526,015 | A | 7/1985 | Laskaris | |
| 4,959,111 | A | 9/1990 | Kruck | |
| 5,081,761 | A | 1/1992 | Rinehart et al. | |
| 5,157,893 | A | 10/1992 | Benson et al. | |
| 5,175,975 | A | 1/1993 | Benson et al. | |
| 5,375,428 | A | 12/1994 | LeClear | |
| 5,406,805 | A | 4/1995 | Radermacher | |
| 5,694,779 | A | 12/1997 | Matsushima | |
| 6,037,033 | A | 3/2000 | Hunter | |
| 6,073,944 | A | 6/2000 | Moore | |
| 6,167,715 | B1 * | 1/2001 | Hebert | F28D 7/0008 62/260 |
| 6,257,684 | B1 | 7/2001 | Hirath et al. | |
| 6,393,798 | B1 | 5/2002 | Hirath et al. | |
| 6,479,112 | B1 | 11/2002 | Shukuri et al. | |
| 6,938,968 | B2 | 9/2005 | Tanimoto et al. | |
| 7,003,973 | B2 | 2/2006 | Lee et al. | |
| 7,638,181 | B2 | 12/2009 | Tenra | |
| 7,806,955 | B2 | 10/2010 | Wang et al. | |
| 7,833,327 | B2 | 11/2010 | Hirai | |
| 8,365,551 | B2 * | 2/2013 | Hanley | F25B 40/00 62/440 |
| 9,377,227 | B2 * | 6/2016 | Jung | F25D 23/061 |
| 10,228,169 | B2 * | 3/2019 | Jung | F25B 40/00 |
| 2001/0055478 | A1 * | 12/2001 | Scherzer | H01K 1/24 392/407 |
| 2003/0167789 | A1 | 9/2003 | Tanimoto et al. | |
| 2004/0144130 | A1 | 7/2004 | Jung | |
| 2004/0177636 | A1 * | 9/2004 | Jolly | F24F 5/0089 165/53 |
| 2005/0175809 | A1 | 8/2005 | Hirai et al. | |
| 2005/0200252 | A1 | 9/2005 | Muller et al. | |
| 2005/0235682 | A1 | 10/2005 | Hirai | |
| 2006/0065013 | A1 | 3/2006 | Kurita | |
| 2007/0214824 | A1 | 9/2007 | Itsuki | |
| 2008/0110128 | A1 * | 5/2008 | Hirath | F25D 23/065 52/794.1 |
| 2009/0266105 | A1 | 10/2009 | Viklund | |
| 2010/0279055 | A1 | 11/2010 | Song | |
| 2011/0259040 | A1 | 10/2011 | Cataldo et al. | |
| 2012/0060543 | A1 | 3/2012 | Hanley et al. | |
| 2012/0104002 | A1 | 5/2012 | Jung et al. | |
| 2013/0029082 | A1 | 1/2013 | Park | |

FOREIGN PATENT DOCUMENTS

| | | |
|---|---|---|
| CN | 2226260 | 5/1996 |
| CN | 2241851 | 12/1996 |
| CN | 1536305 | 10/2004 |
| CN | 2720362 | 8/2005 |
| CN | 2777463 | 5/2006 |
| CN | 101038121 | 9/2007 |
| CN | 101040155 | 9/2007 |
| CN | 101487652 | 7/2009 |
| CN | 101595340 | 12/2009 |
| CN | 101793455 | 8/2010 |
| CN | 101865584 | 10/2010 |
| EP | 0071090 | 2/1983 |
| EP | 1291596 | 3/2003 |
| EP | 1441187 | 7/2004 |
| EP | 1 835 242 | 9/2007 |
| JP | 2005163848 | 6/2005 |
| JP | 2007-315662 | 12/2007 |
| JP | 2008-101887 | 5/2008 |
| JP | 2008101887 | 5/2008 |
| JP | 2010276310 | 12/2010 |
| JP | 2011080692 | 4/2011 |
| KR | 1020040067648 | 7/2004 |
| WO | 2011/016697 | 9/2010 |
| WO | 2010/105884 | 2/2011 |
| WO | 2011/016693 | 2/2011 |

OTHER PUBLICATIONS

U.S. Office Action dated Jun. 27, 2014 for U.S. Appl. No. 13/665,057, 14 pages.

Chinese Office Action dated Jul. 7, 2014 for Chinese Application No. 201210428777.9, with English Translation, 26 pages.

Chinese Office Action dated Jul. 24, 2014 for Chinese Application No. 201210432112.5, with English Translation, 21 pages.

Chinese Office Action dated Aug. 1, 2014 for Chinese Application. No. 201210433194.5, with English Translation, 17 pages.

U.S. Office Action dated Dec. 15, 2014 for U.S. Appl. No. 13/654,551, 11 Pages.

U.S. Office Action dated Mar. 5, 2015 for U.S. Appl. No. 13/655,677, 18 pages.

U.S. Final Office Action dated Aug. 31, 2015, for U.S. Appl. No. 13/655,677, 37 pages.

U.S. Advisory Action dated Dec. 15, 2015, for U.S. Appl. No. 13/655,677, 5 pages.

U.S. Notice of Allowance dated Mar. 21, 2016, for U.S. Appl. No. 13/655,677, 12 pages.

Office Action issued in Chinese Application No. 201510430146.4 dated Nov. 4, 2016, with English translation, 27 pages.

Partial European Search Report in European Application No. 12007265.7, dated Apr. 26, 2017, 8 pages (with English translation).

Office Action in Korean Appln. No. 10-2021-0163084, dated Mar. 7, 2022, 10 pages (with English translation).

Extended European Search Report in European Appln. No. 22194156.0, dated Nov. 25, 2022, 8 pages.

Notice of Allowance in Korean Appln. No. 10-2021-0163084, dated Oct. 28, 2022, 10 pages (with English translation).

* cited by examiner

REFRIGERATOR WITH VACUUM INSULATION HOUSING A HEAT INTERCHANGER

CROSS-REFERENCE TO RELATED APPLICATION

This application is a continuation of U.S. application Ser. No. 15/182,652, filed Jun. 15, 2016, now allowed, which is a continuation of U.S. application Ser. No. 13/655,677, filed Oct. 19, 2012, now U.S. Pat. No. 9,377,227, which claims the benefit of a foreign priority application filed in Korea as Application No. 10-2011-0114571 on Nov. 4, 2011. The disclosures of the prior applications are incorporated by reference in their entirety

BACKGROUND

1. Field

Embodiments of the invention relate to a refrigerator, more particularly, to a refrigerator including a vacuum space formed between an outer case and an inner case to improve an insulation function thereof.

2. Background

A refrigerator is an electric home appliance can keep food stored in a storage compartment at a low temperature or a temperature below zero, using a refrigerant cycle.

A conventional configuration of such a refrigerator is provided with a case where a storage space is defined to store foods and a door rotatably or slidingly coupled to the case to open and close the storage space.

The case includes an inner case where the storage space is formed and an outer case configured to accommodate the inner case. An insulating material is arranged between the inner case and the outer case.

Such an insulating material suppresses the outdoor temperature from affecting an internal temperature of the storage space.

An example of the insulation material is urethane foams. Such urethane foams can be injection-foamed in the space formed between the inner and outer cases.

In this instance, to realize an insulation effect by using such the insulating material, a predetermined thickness of the insulating material has to be secured and that means that the insulating material becomes thick. Accordingly, a wall between the inner and outer cases becomes thick and the size of the refrigerator is increased as much as the thickness.

However, as a recent trend of a compact-sized refrigerator is one the rise, there is the need for the structure of the refrigerator that can make the volume of the internal storage space larger and the external size smaller.

Accordingly, the present invention proposes a refrigerator having a new structure which can perform insulation by forming a vacuum space, not by injecting the insulating material between the inner case and the outer case.

Meanwhile, vapors might be cooled and changed into frost in an evaporator composing a freezing cycle provided in the refrigerator. Such frost might be stuck to a surface of the evaporator. To solve such a problem of frost, a defrosting apparatus may be provided in the refrigerator to remove the frost by heating the frost to change it into water.

The water melted by the defrosting apparatus is exhausted to the outside of the refrigerator via a drainage pipe and such a drainage pipe is connected to the outside passing through the inner case, the outer case and the insulating material provided between the inner and outer cases.

Rather than such the drainage pipe, another pipe may be connected to the outside from the inside of the refrigerator.

In the conventional refrigerator having a foaming agent provided in the space between the inner case and the outer case, the pipe is simply connected to pass through the inner case, the insulating material and the outer case.

Accordingly, the pipe is molded of plastic and the plastic-molded pipe is disposed to pass the inner case and the outer case, and then the insulating material is foaming.

However, in the vacuum refrigerator according to the present invention, the pipe is connected to pass the vacuum space, with maintaining the airtight state of the vacuum space. If the plastic pipe is used, it is difficult to maintain the airtight state at the connection area between the pipe and the vacuum space and the connection area cannot endure the vacuum pressure of the vacuum space disadvantageously.

Moreover, if the pipe is formed of a metal pipe capable of being welded to the inner case and the outer case formed of a steel sheet, heat transfer might be generated via the pipe and an insulation performance of the refrigerator might be deteriorated accordingly.

SUMMARY

To solve the problems, an object of the invention is to provide a refrigerator that is able to improve an insulation effect by forming the vacuum space between the inner case and the outer case and to promote a compact volume.

Another object of the present invention is to provide a refrigerator that is able to form the vacuum space between the inner case and the outer case and that has a supporting structure to maintain the distance between the inner case and the outer case, without deformation of the inner and outer cases generated by an external shock.

A further object of the present invention is to provide a refrigerator having a structure that can reduce deterioration of the insulation performance by arranging a liquid-gas interchanger in the vacuum space.

To achieve these objects and other advantages and in accordance with the purpose of the embodiments, as embodied and broadly described herein, a refrigerator comprises an inner case that defines a storage space; an outer case spaced apart a distance from the inner case, the outer case and the inner case defining, between the outer case and the inner case, a vacuum space that is maintained at a partial vacuum pressure and that is configured to insulate the inner case from the outer case; and a liquid-gas interchanger that is arranged in the vacuum space and that is configured to facilitate heat exchange between refrigerant exhausted from an evaporator and refrigerant exhausted from a condenser.

The liquid-gas interchanger may be configured to perform heat exchange by conduction within the vacuum space.

The liquid-gas interchanger may have at least one curved portion.

The liquid-gas interchanger may have a shape that substantially corresponds to an 'S' shape.

The liquid-gas interchanger may comprises a compressor suction tube that guides the refrigerant exhausted from the evaporator toward a compressor; and a capillary tube that guides the refrigerant exhausted from the condenser to an expansion valve.

The compressor suction tube may be in contact with the capillary tube.

The compressor suction tube may have a first end fixed through the inner case and a second end fixed through the outer case and the capillary tube has a first end fixed through the inner case and a second end fixed through the outer case.

The compressor suction tube may be spaced apart from the inner case and the outer case, except for the first end of the compressor suction tube fixed through the inner case and the second end of the compressor suction tube fixed through the outer case, and the capillary tube is spaced apart from the inner case and the outer case, except for the first end of the capillary tube fixed through the inner case and the second end of the capillary tube fixed through the outer case.

The liquid-gas interchanger may further comprise a plurality of guide rings that support the compressor suction tube and the capillary tube and that maintain the compressor suction tube and the capillary tube spaced apart from the inner case and the outer case.

The plurality of guide rings may surround the compressor suction tube and the capillary tube.

The compressor suction tube and the capillary tube may be copper tubes, and the plurality of guide rings may be ceramic or poly carbonate guide rings.

The capillary tube may be welded to the inner case at a first position and welded to the outer case at a second position, and the compressor suction tube is welded to the inner case at a third position and welded to the outer case at a fourth position, the first, second, third, and fourth positions all being different.

The refrigerator may further comprise a first support plate located at a surface of the inner case that faces the outer case; a second support plate located at a surface of the outer case that faces the first support plate; and a plurality of spacers fixed to the first support plate and configured to maintain the vacuum space between the inner case and the outer case.

The second support plate may comprise a plurality of grooves that are defined in an inner surface of the second support plate and that are configured to receive ends of the spacers therein.

The liquid-gas interchanger may be arranged between the plurality of the spacers such that the liquid-gas interchanger does not contact the plurality of spacers.

In another aspect of the present invention, a refrigerator comprises an inner case that defines a storage space; an outer case spaced apart a distance from the inner case, the outer case and the inner case defining, between the outer case and the inner case, a vacuum space that is maintained at a partial vacuum pressure and that is configured to insulate the inner case from the outer case; and a liquid-gas interchanger arranged in the vacuum space, wherein the liquid-gas interchanger has a shape that substantially corresponds to an 'S' shape.

The liquid-gas interchanger may comprise a compressor suction tube that guides refrigerant exhausted from an evaporator toward a compressor; and a capillary tube that guides refrigerant exhausted from a condenser to an expansion valve.

The liquid-gas interchanger may be configured to perform heat exchange by conduction within the vacuum space.

In further aspect of the present invention, a refrigerator comprises an inner case that defines a storage space; an outer case spaced apart a distance from the inner case, the outer case and the inner case defining, between the outer case and the inner case, a vacuum space that is maintained at a partial vacuum pressure and that is configured to insulate the inner case from the outer case; a liquid-gas interchanger that is arranged in the vacuum space and that is configured to facilitate heat exchange between refrigerant exhausted from an evaporator and refrigerant exhausted from a condenser; a support plate positioned between the outer case and the inner case; and a plurality of spacers fixed to the support plate and configured to maintain the distance between the inner case and the outer case.

The liquid-gas interchanger may be arranged between the plurality of the spacers such that the liquid-gas interchanger does not contact the plurality of spacers.

The refrigerator according to embodiments has following advantageous effects. According to the refrigerator, the vacuum space is formed between the inner case and the outer case, instead of the conventional insulating material. Such the vacuum space performs the insulation to restrain heat transfer between the inner case and the outer case.

The insulation effect of the vacuum state is more excellent than the conventional insulating material. The refrigerator according to the present invention has an advantage of excellent insulation, compared with the insulation effect achieved by the conventional insulating material the conventional refrigerator. The refrigerator according to the present invention has an advantage of good insulation, compared with the conventional refrigerator.

Meanwhile, if the vacuum state of the vacuum space is maintained, the insulation function is performed, regardless of the thickness (the distance between the inner case and the outer case). However, the thickness of the conventional insulating material has to be larger to enhance the insulating effect and such increase of the thickness results in increase of the refrigerator size.

Accordingly, compared with the conventional refrigerator, the refrigerator according to the present invention can reduce the size of the outer case while maintaining the storage compartment with the same size. Accordingly, the present invention can be contributed to a compact sized refrigerator.

Still further, the liquid-gas interchanger is arranged in the vacuum space and the heat transfer can be reduced by the liquid-gas interchanger accordingly. The insulation performance may be improved.

It is to be understood that both the foregoing general description and the following detailed description of the embodiments or arrangements are exemplary and explanatory and are intended to provide further explanation of the embodiments as claimed.

BRIEF DESCRIPTION OF THE DRAWINGS

Arrangements and embodiments may be described in detail with reference to the following drawings in which like reference numerals refer to like elements and wherein.

DETAILED DESCRIPTION

Exemplary embodiments of the present invention will be described in detail, referring to the accompanying drawing figures which form a part hereof.

Figure 1:
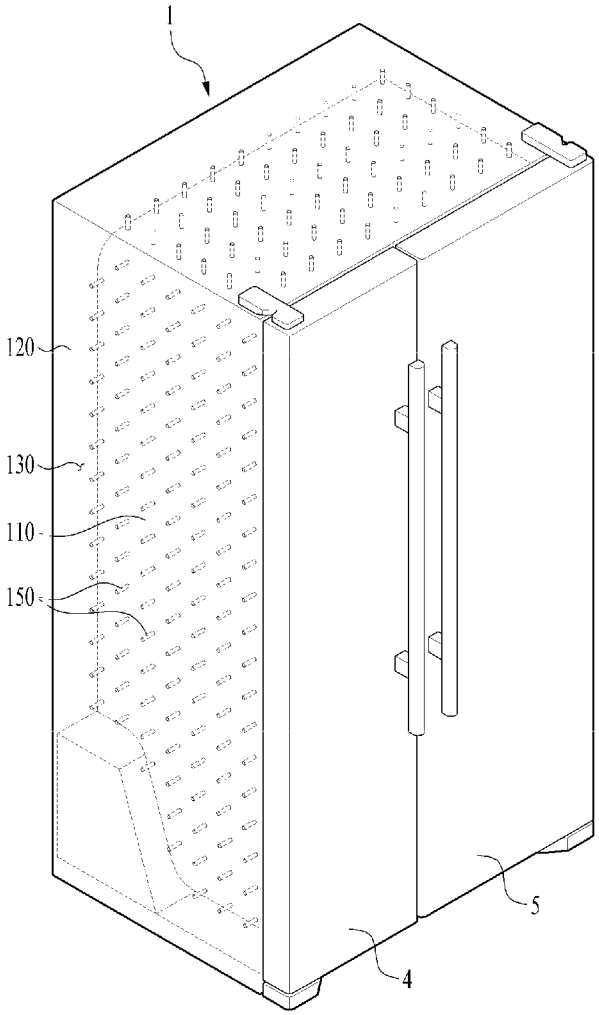
FIG. 1 is a perspective view of a refrigerator according to one embodiment of the present invention.

FIG. 1 illustrates a refrigerator according to one embodiment of the present invention.

As shown in FIG. 1, the refrigerator according to one embodiment of the present invention includes a case 1 in which a storage chamber is formed, a first door 4 rotatably coupled to a left side of the case 1 and a second door 5 rotatably coupled to right side of the case 1.

The first door 4 is configured to open and close a freezer compartment that consists of the storage compartment and the second door 5 is configured to open and close a refrigerator compartment that consists of the storage compartment. By nonlimiting example, the present invention may include various types of refrigerator.

In other words, the refrigerator shown in FIG. 1 is a side-by-side type having a refrigerator compartment arranged on the left and a freezer compartment arranged on the right. The refrigerator according to the present invention may be all types of refrigerators no matter how the refrigerator and freezer compartments are arranged. Also, the refrigerator may be a refrigerator only having a refrigerator or freezer compartment or a refrigerator having an auxiliary cooler compartment rather than the freezer and refrigerator compartments.

An outer case 120 is spaced apart a predetermined distance from an inner case 110. No auxiliary insulating material is provided in a space formed between the outer case 120 and the inner case 110 and the space is maintained in a vacuum state to perform insulation.

In other words, the vacuum space 130 is formed between the outer case 120 and the inner case 110, to remove a medium that delivers the heat between the cases 110 and 120.

Accordingly, the heat from the hot air outside the outer case 120 can be prevented from being transmitted to the inner case as it is.

Meanwhile, for convenience sake, FIG. 1 shows the inner case 110, the outer case 120, and spacers 150 that consist of the case, without a liquid-gas interchanger 200 which will be described later.

Figure 2:
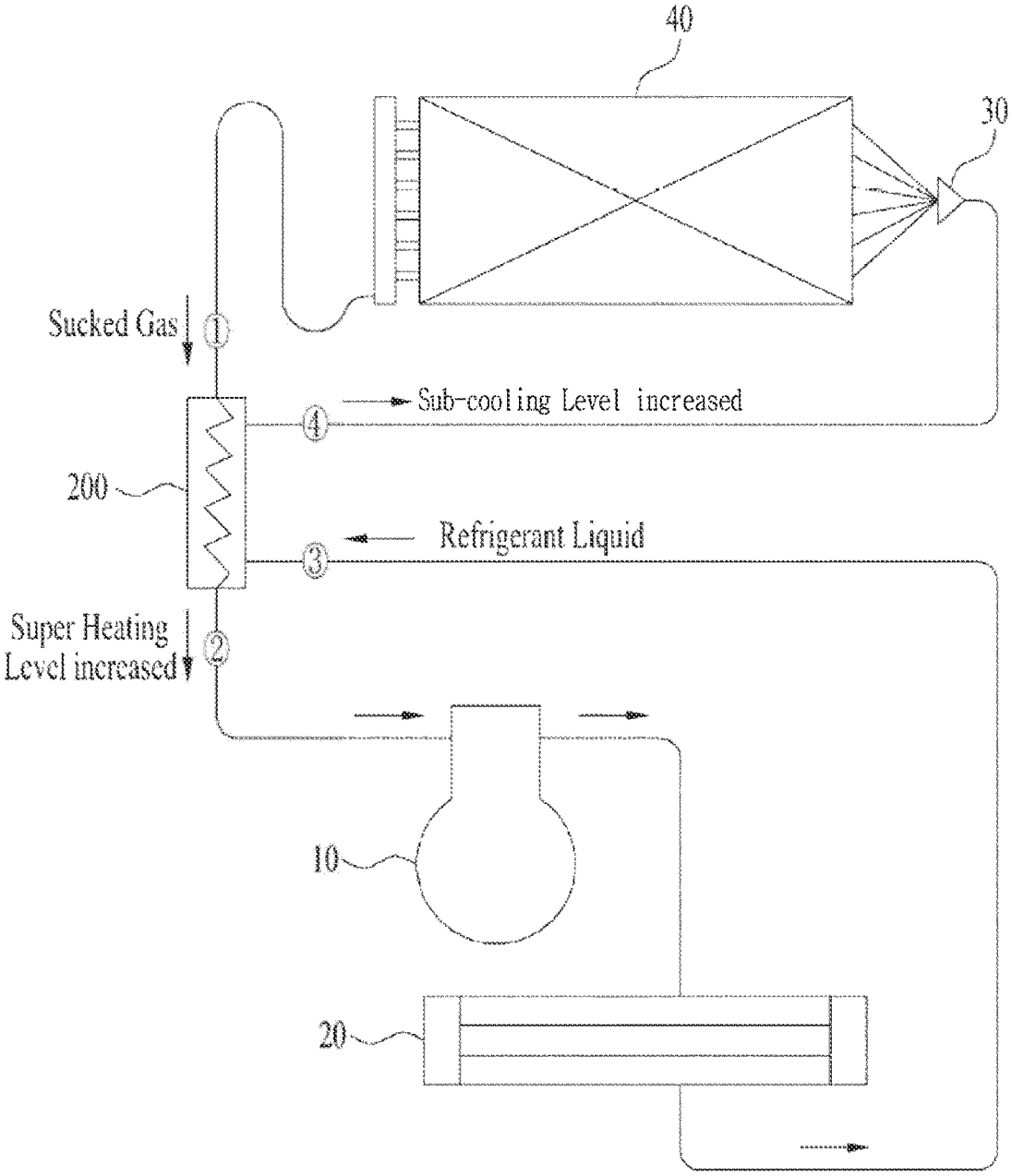
FIG. 2 is a schematic diagram illustrating a function of a liquid-gas interchanger in a cooling cycle of the refrigerator.
Figure 3:
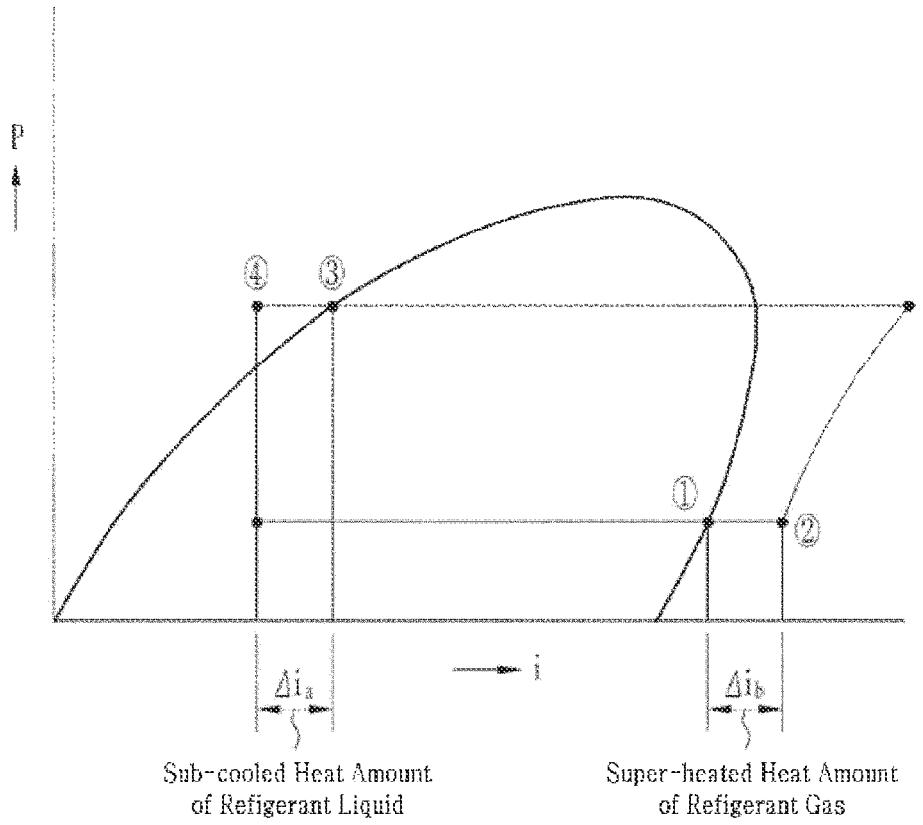
FIG. 3 is a Mollier diagram illustrating the function of the liquid-gas interchanger.

Referring to FIGS. 2 and 3, the liquid-gas interchanger 200 provided in the vacuum space of the refrigerator according to the present invention will be described.

FIG. 2 is a schematic diagram illustrating a function of the liquid-gas interchanger in a cooling cycle of the refrigerator. FIG. 3 is a Mollier diagram (P-i chart or pressure-enthalpy diagram) illustrating the function of the liquid-gas interchanger.

The cooling cycle refers to a refrigerant circulation cycle configured to provide cold air, while refrigerant is heat-exchanging with external air via a compressor, an evaporator, an expansion valve and an evaporator.

As shown in FIG. 2, the refrigerant vaporized in the evaporator 40 is compressed in the compressor 10 and then it is condensed into fluidal refrigerant in the condenser 20. That liquid refrigerant is expanded while passing the expansion valve 30 and vaporized in the evaporator to absorb heat of latent air to generated cold air.

However, to overcool the refrigerant liquid exhausted from the condenser 20 and to super-heat the refrigerant gas precisely at the same time, the liquid-gas interchanger 200 may be installed as shown in FIG. 2.

The liquid refrigerant, in other words, if the refrigerant liquid is almost in a saturated state, might have the pressure thereof lowered by the resistance generated while passing a refrigerant pipe. Or, the liquid pressure might be lowered by a standing state of a liquid pipe or heat penetration might be generated by a high temperature of latent air. Because of that, flash gas might be generated in the refrigerant liquid and the pipe resistance might be increased remarkably accordingly. Especially, the ability of the expansion valve might be decreased remarkably only to deteriorate the freezing ability.

To prevent such disadvantages, the refrigerant liquid is sub-cooled. In other words, the refrigerant liquid almost in the saturated state (in a state of ③ shown in FIG. 3) after passing the condenser is sub-cooled to a state of ④.

As shown in Mollier diagram of FIG. 3, such sub-cooling may cool the refrigerant liquid by $\Delta i_a$ to increase a freezing effect by $\Delta i_a$ when the refrigerant liquid having passed the expansion valve is vaporized in the evaporator.

Based on the type of the evaporator, it cannot be said that the seething refrigerant drawn into a suction pipe is completely in a vaporized vapor state. For instance, liquid particles remain in a flooded type evaporator when the seething refrigerant is absorbed. Based on an operation condition, refrigerant in a humid vapor state can be absorbed in another type evaporator. In this instance, such the liquid-gas interchanger 200 is used in increasing a super heat degree of the absorbed gas.

Also, refrigerant is mixed with lubrication oil in the flooded type evaporator and a liquid surface is maintained relatively high, such that the oil might be absorbed into a suction pipe together with the refrigerant from an evaporation surface.

In this instance, the liquid-gas interchanger 200 heats the refrigerant to enable the refrigerant sucked into the suction pipe at an appropriate super heat level. Simultaneously, the oil is separated from the refrigerant and the refrigerant is re-supplied to the compressor via the suction pipe.

As shown in the chart of FIG. 3, the refrigerant gas exhausted from the evaporator 40 has an enthalpy such as ① and a super heat level of the refrigerant is increased while the refrigerant is passing the liquid-gas interchanger 200, to be ②. The refrigerant having the enthalpy increased by $\Delta i_b$ may be drawn into the compressor.

Accordingly, the refrigerator according to the present invention include the liquid-gas interchanger 200 to sub-cool the refrigerant liquid flowing toward the expansion valve 30 and to super-heat the refrigerant gas sucked into the compressor 10 simultaneously to enhance cooling efficiency of the cooling cycle.

Figure 4:
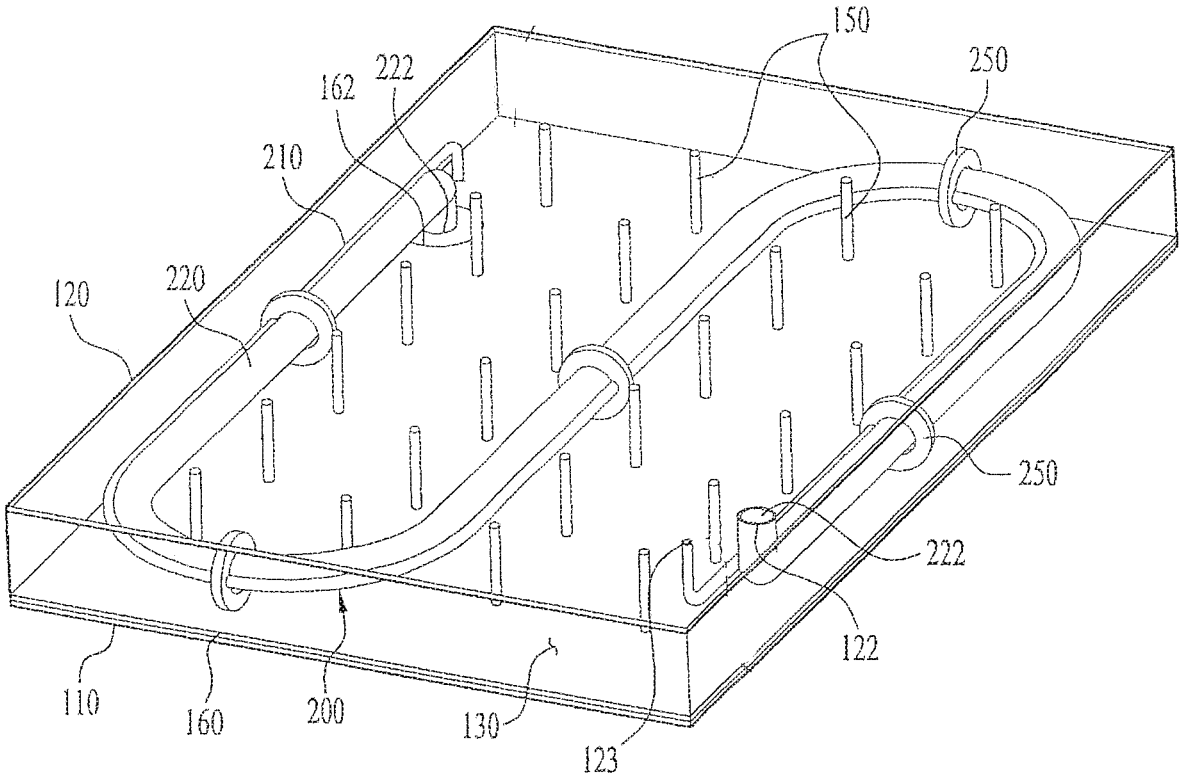
FIG. 4 is a partially cut-away perspective view illustrating the liquid-gas interchanger provided in a vacuum space formed between an inner case and an outer case of the refrigerator according to the present invention.
Figure 5:
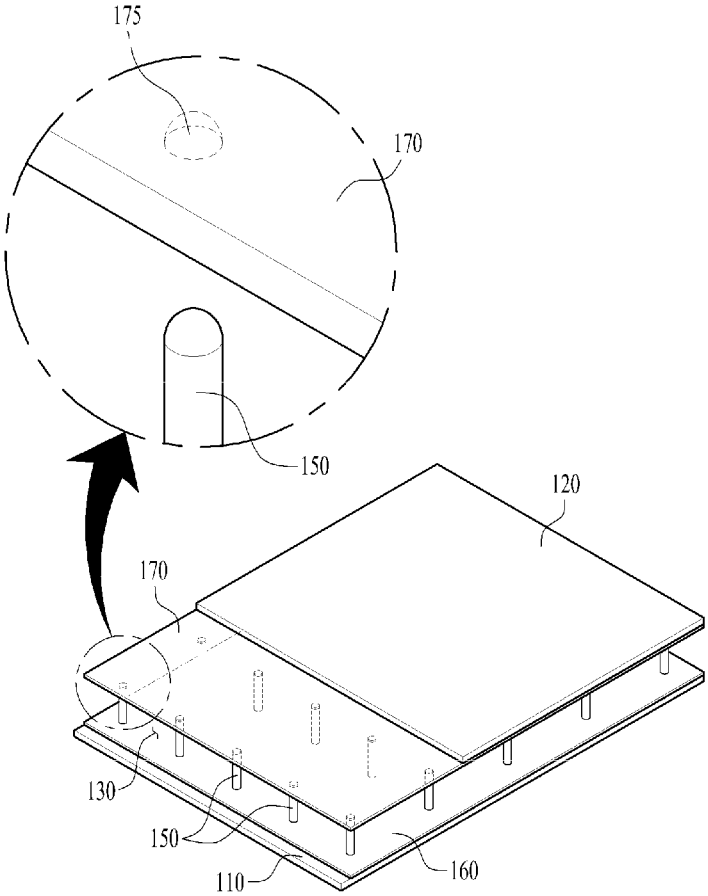
FIG. 5 is a partially cut-away perspective view illustrating an assembling structure among the inner case, the outer case and spacers.

Referring to FIGS. 4 and 5, the structure of the refrigerator having the liquid-gas interchanger 200 will be described as follows.

FIG. 4 is a partially cut-away perspective view illustrating the liquid-gas interchanger provided in a vacuum space formed between an inner case and an outer case of the refrigerator according to the present invention. FIG. 5 is a partially cut-away perspective view illustrating an assembling structure among the inner case, the outer case and spacers.

The outer case 120 is opaque and the inside of the vacuum space 130 is invisible. However, the inside of the vacuum space 130 is visible in FIG. 4 for convenience sake.

According to the refrigerator, the case 1 includes an inner case 110 in which the storage space is formed, an outer case 120 accommodating the inner case, spaced apart a predetermined distance from the inner case, vacuum space 130 provided between the inner case and the outer case, with being closed to maintain a vacuum state to perform the insulation function between the inner case and the outer case, and a liquid-gas interchanger 200 configured to generate heat exchange between the refrigerant after passing an evaporator and the refrigerant before drawn into an evaporator.

Especially, the liquid-gas interchanger 200 is arranged in the vacuum space 130, with forming a long passage, and it may generate heat exchange between the low temperature refrigerant gas after passing the evaporator and a normal temperature refrigerant liquid before drawn into the evaporator.

Meanwhile, the liquid-gas interchanger 200 is provided in the vacuum space 130 and heat exchanger can be generated by conduction. If a vacuum level of the vacuum space 130 is high, heat exchange is not generated by convection in the vacuum space 130.

Both pipe ends of the liquid-gas interchanger 200 may be welded to the inner case 110 and the outer case 120, respectively, to secure a sufficient fixing force.

In addition, the liquid-gas interchanger is formed of a metal material. To reduce heat transfer, it is preferred to reduce contact areas between a metal pipe of the liquid-gas interchanger and the inner and outer cases 110 and 120 or other components provided in the vacuum space 130.

As shown in FIGS. 4 and 5, a plurality of the spacers 150 may be arranged to maintain the distance between the inner case 110 and the outer case 120 to make the vacuum space 130 maintain its profile. Such spacers 150 may support the first support plate to maintain the distance between the inner case 110 and the outer case 120.

The plurality of the spacers 150 may be fixed between the inner case 110 and the outer case 120. The plurality of the spacers 150 may be arranged in the first support plate 160 as a fixing structure.

The first support plate 160 may be provided in contact with one of facing surfaces possessed by the inner and outer cases 110 and 120.

In FIGS. 4 and 5, it is shown that the first support plate 160 is arranged to contact with an outer surface of the inner case 110. Optionally, the first support plate 160 may be arranged to contact with an inner surface of the outer case 120.

The first support plate 160 is arranged in contact with an outer surface of the inner case 110 and a second support plate 170 arranged in contact with an inner surface of the outer case 120 may be further provided, such that ends of the spacers 150 provided in the first support plate 160 may be in contact with an inner surface of the second support plate 170.

As shown in FIG. 5, the case 1 may further include a second support plate 170 provided in the other one of facing surfaces possessed by the first and second cases 110 and 120, with facing the first support plate.

In the embodiment shown in FIG. 5, the second support plate 170 is arranged to contact with the inner surface of the outer case 20 and the spacers 150 are fixedly arranged in the first support plate 160 to maintain a distance spaced apart between the first support plate 160 and the second support plate 170.

The first support plate 160 is in contact with the outer surface of the inner case 110 and the second support plate 170 is in contact with the inner surface of the outer case 120. Accordingly, the spacers 150 supportably maintain the distance between the inner case 110 and the outer case 120.

As shown in FIG. 4, in case of no second support plate 170 as mentioned above, ends of the spacers 150 may be arranged to directly contact with the inner surface of the outer case 120.

As shown in an enlarged view of FIG. 5, the second support plate 170 may include a plurality of grooves 175 formed in an inner surface thereof to insert ends of the spacers 150 therein, respectively.

The plurality of the grooves 175 formed in the second support plate 170 may facilitate the fixing of relative position with respect to the spacers 150, when the second support plate 170 is placed on the spacers 150 integrally formed with the first support plate 160.

The vacuum space 130 has to be formed between the inner and outer cases 110 and 120 composing the case 1. For instance, rim portions of the inner and outer cases 110 and 120 that form one surface of the case 1 have to be integrally formed with each other, with the corresponding size to the size of the one surface.

In contrast, first and second support plate units are fabricated, with a smaller size than the size of the inner or outer case 110 or 120. After that, sets of assembled first and second support plates having the spacers 150 positioned there between are fabricated and the sets of the assembled plates are inserted between the inner case 110 and the outer case 120.

Optionally, the first support plate 160 and the second support plate 170 are fabricated and assembled, with the same size as the inner and outer cases 110 and 120.

FIG. 5 partially illustrates the assembling structure between the inner case 110 and the outer case 120 in a multilayered structure.

An end of each spacer 150 may be concavely curved.

As shown in a circle enlarged in FIG. 5, ends of the spacers 150 are concavely curved. In the assembly process, the end of each spacer 150 is easily seated in each groove 175 formed in the second support plate 170, only to ease the assembling work.

Moreover, it is more preferred that the plurality of the grooves 175 formed in the second support plate 170 are convexly curved, corresponding to the shape of the spacers 150.

The shapes of the grooves 175 formed in the second support plate 170 may be corresponding to the shapes of the spacers 150. Accordingly, it is easy to determine the positions of the spacers in the assembling work and the second support plate 170 can be fixed in parallel with the ends of the spacers, without movement.

The spacers 150, the first support plate 160 and the second support plate 170 may be formed of one of metal, ceramic and reinforced plastic.

The spacers 150 integrally formed with the first support plate 160 are aligned in vertical and horizontal lines as shown in FIGS. 4 and 5.

As the spacers 150 are arranged in such lines, the design and molding fabrication may be facilitated. Also, the assembling work can be facilitated and the strength for enduring the vacuum pressure or the external shock in the vacuum space 130 can be enlarged after the assembling process.

Go back to FIG. 4, the mounding structure of the liquid-gas interchanger 200 will be described in detail.

The liquid-gas interchanger 200 includes a compression suction pipe 220 for guiding the refrigerant having passed the evaporator to the compressor and a capillary tube 210 for guiding the refrigerant having passed the condenser to the expansion valve.

It is preferred that the liquid-gas interchanger 200 is arranged between the spacers 150, not in contact with them.

The liquid-gas interchanger 200 is arranged in the vacuum space 130 and both ends of the liquid-gas interchanger 200 are fixed to the inner case 110 and the outer case 120, respectively. At this time, it is possible to weld the liquid-gas interchanger 200 to the inner case 110 and the outer case 120. Such the liquid-gas interchanger 200 may be mounted not in contact with nor interfering with the spacers 150 aligned in the vacuum space 130.

Accordingly, the external heat of the outer case 120 can be prevented from transferred to the inside of the inner case 110 via the spacers 150 by conduction.

The compressor suction pipe 220 where the low temperature refrigerant gas having passed the evaporator 40 is flowing to the compressor is welded to the capillary tube 210 where the normal temperature refrigerant liquid is flowing before sucked into the evaporator in the liquid-gas interchanger 200, to contact with each other. After that, the ends of the liquid-gas interchanger 200 are welded to the inner case 110 and the outer case 120, respectively.

At this time, the compressor suction pipe 220 and the capillary tube 210 are in contact with each other. Accordingly, heat exchange may be performed by conduction between the compressor suction pipe 220 and the capillary tube 210.

As shown in FIG. 4, the compressor suction pipe 220 is a refrigerant pipe where the low temperature refrigerant gas having passed the evaporator 40 is flowing to the compressor 10. Compared with the capillary tube 210, the compressor suction pipe 220 has a larger diameter.

The capillary tube 210 is a refrigerant pipe where the normal temperature refrigerant liquid is flowing before sucked into the evaporator. Compared with the compressor suction pipe 220, the capillary tube 210 has a relatively smaller diameter.

There may be various types of liquid-gas interchangers. Such various types include a shell and tube type liquid-gas interchanger, a pipe contact type liquid-gas interchanger and a dual pipe type liquid-gas interchanger.

The liquid-gas interchanger 200 used in the present invention may be a pipe contact type liquid-gas interchanger. The liquid-gas interchanger 200 includes the compressor suction pipe 220 and the capillary tube 210 which are welded to contact with each other in a long pipe shape.

That is because the vacuum space 130 where the liquid-gas interchanger 200 is mounted has a relatively small thickness and a large area.

In addition, both ends 222 of the liquid-gas interchanger 200 are arranged in predetermined positions, respectively. To form a longer passage than a linear distance between the ends 222, at least one portion of the liquid-gas interchanger 200 may be curved. In other words, it is preferred that the liquid-gas interchanger 200 is formed in an S-shape to form a plurality of curvature points.

Accordingly, the liquid-gas interchanger 200 may be referenced to as 'S-pipe' called after the S-shape.

As shown in FIG. 4, an end 222 of the liquid-gas interchanger 200 may be welded to a communication hole 122 formed in the outer case 120 and the other end 222 of the liquid-gas interchanger 200 may be welded to a communication hole (not shown) formed in the inner case 110.

A communication hole 162 may be formed in a welded portion of the first support plate 160 between the inner case 110 and the end 222 of the liquid-gas interchanger 200. Such a communication hole 162 forms a concentric circle with the welded portion and has a larger diameter than the welded portion.

FIG. 4 shows only the first support plate 160 and not second support plate 170. When the second support plate 170 is provided together with the first support plate 160 as shown in FIG. 5, a communication hole may be formed in a portion of the second support plate 170 corresponding to the welded portion between the other end 222 of the liquid-gas interchanger 200 and the outer case 120. The communication hole is concentric with respect to the welded portion and it has a larger diameter than the welded portion.

The inner case 110 and the outer case 120 are fabricated of a steel sheet, and they may be formed of metal, ceramic or reinforced plastic.

When the liquid-gas interchanger 200 is welded to the inner case 110 and the outer case 120, the first support plate 160 and the second support plate 170 as the structure for supporting the spacers 150 could be affected. Accordingly, it is preferred that the communication hole 122 of the case is larger than the communication hole 162 of the support plate.

As mentioned above, it is preferred that the liquid-gas interchanger 200 is be spaced apart from the inner case 110 and the outer case 120, except the welded portion of the ends.

That is because the insulation performance can be deteriorated by heat conduction generated via a contact area between the liquid-gas interchanger 200 formed of metal and the inner case 110 or the outer case 120 or the first support plate 160 or the second support plate 170, when the liquid-gas interchanger 200 contacts with the inner case 110 or the outer case 120 or the first support plate 160 or the second support plate 170.

To prevent such heat conduction, the case 1 may further include a plurality of guide rings 250 arranged to surround the liquid-gas interchanger 200 to support the liquid-gas interchanger 200 spaced apart from the inner and outer cases 110 and 120.

The guide rings 250 are configured of rings surrounding the liquid-gas interchanger 200, namely, the compressor suction pipe 220 and the capillary tube 210 connected with each other.

Such the guide rings 250 are spaced apart a predetermined distance from the inner case 110 and the outer case 120.

Specifically, when the first support plate 160 and the second support plate 170 are provided, the guide rings 250 makes the liquid-gas interchanger 200 spaced apart from the first support plate 160 and the second support plate 170, without contact.

The guide rings 250 may be employed to fix the compressor suction pipe 220 and the capillary tube 210 to maintain the contact state between them.

Especially, the refrigerant is flowing in the compressor suction pipe 220 and the capillary tube 210. Accordingly, predetermined vibration might be generated and such vibration might make the compressor suction pipe 220 and the capillary tube 210 momentarily contact with the inner case 110 and the outer case 120. Also, the compressor suction pipe 220 and the capillary tube 210 might be distant from each other by the vibration from the contact state. Such problems can be solved by the guide rings 250.

The guide rings 250 may be arranged along a longitudinal direction of the liquid-gas interchanger 200 at predetermined intervals, to enable the liquid-gas interchanger 200 spaced apart from the other case or support plate in the vacuum space 130.

The liquid-gas interchanger 200 is formed of two connected pipes having different diameters. An inner circumferential surface shape of the guide ring 250 is corresponding to an outer circumferential surface shape of the liquid-gas interchanger 200.

Meanwhile, FIG. 4 shows that the guide rings 250 are circular rings and they may have any shapes only if the liquid-gas interchanger 200 is inserted therein to be supportedly distant from the case or support plate.

Heat exchange has to be actively generated in the liquid-gas interchanger 200 and the liquid-gas interchanger 200 may be formed of copper that has a high heat conductivity.

Both ends of the liquid-gas interchanger 200 formed of such a copper material may be welded to the inner case and the outer case formed of a steel sheet. Accordingly, airtightness sufficient to endure the vacuum pressure of the vacuum space 130 can be maintained in the liquid-gas interchanger 200.

Moreover, the ends of the liquid-gas interchanger 200 are welded to the inner case 110 and the outer case 120, respectively, to pass through the vacuum space 130 accordingly. However, the liquid-gas interchanger 200 is quite long and the amount of the heat conducted via the liquid-gas interchanger 200 formed of the copper material is little and the insulation performance may not be deteriorated.

The guide rings 250 may be formed of ceramic or poly carbonate (PC).

The guide rings 250 are configured to make the liquid-gas interchanger 200 distant from the case or support plate adjacent thereto. Because of that, the guide rings 250 are formed of ceramic or PC having a low heat conductivity to reduce the heat transfer.

Lastly, the ends of the liquid-gas interchanger 200 may be welded to the inner case 110 and the outer case 120, respectively, with the capillary tube 210 and the compressor suction tube 220 spaced apart from each other.

As shown in FIG. 4, two communication holes 122 and 123 are formed in the outer case 120, spaced apart a predetermined distance from each other to allow the welding of the capillary tube 210 and the compressor suction tube 220 composing the liquid-gas interchanger 200.

A first communication hole 122 of the two communication holes 122 and 123 is welded to the end of the compressor suction tube 220 and a second communication hole 123 is welded to an end of the capillary tube 210.

A diameter of the compressor suction tube 220 is larger than a diameter of the capillary tube 210. Accordingly, the first communication hole 122 may be larger than the second communication hole 123.

It is shown in FIG. 4 that the capillary tube 210 and the compressor suction tube 220 are welded at different positions even at the other end of the liquid-gas interchanger 200.

According to the present invention, the vacuum space having a smaller thickness than the prior art is formed between the inner case and the outer case. Accordingly, the volume of the storage compartment can be enlarged and the insulation performance can be improved in the refrigerator according to the present invention.

Furthermore, the liquid-gas interchanger for improving cooling efficiency in the cooling cycle is installed in the vacuum space. Accordingly, the refrigerator can make the assembly performed easily, with no interference with the insulation performance.

Various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

an inner case in which a storage space is formed;

an outer case accommodating the inner case;

a vacuum space provided between the inner case and the outer case;

a supporting structure to maintain a distance between the inner case and the outer case, without deformation of the inner case and the outer case generated by an external shock;

a heat exchanger configured to generate heat exchange between a refrigerant that has passed an evaporator and a refrigerant that is being drawn into the evaporator; and a plurality of guide structures configured to space the heat exchanger apart from the inner case and the outer case, wherein:

the heat exchanger is provided within the vacuum space;

the supporting structure comprises:

a support plate positioned between the outer case and the inner case; and a plurality of spacers fixed to the support plate and configured to maintain the distance between the inner case and the outer case, the plurality of spacers being arranged in the support plate as a fixing structure;

the support plate extends along an outer surface of the inner case or an inner surface of the outer case such that at least two spacers of the plurality of spacers are fixed to the support plate, and the plurality of spacers support the support plate to maintain the distance between the inner case and the outer case, each of the guide structures being spaced apart from one another and from the plurality of spacers without contacting the plurality of spacers;

the support plate is made of a material that is different from the heat exchanger to reduce heat transfer via the heat exchanger towards at least one of the inner case and the outer case;

the plurality of spacers and the support plate are integrally molded as one body by using a material of a plastic, the plurality of spacers protruding from a surface of the support plate;

a first end of the heat exchanger is fixed to the inner case;

a second end of the heat exchanger is fixed to the outer case;

a location at which the first end is fixed to the inner case is proximate to a location where one or more of the plurality of spacers are disposed on the inner case; and a location at which the second end is fixed to the outer case is proximate to a location where one or more of the plurality of spacers are disposed on the outer case.

2. The refrigerator according to claim 1, wherein the support plate and the plurality of spacers are arranged between the inner case and the outer case as a single assembly.

3. The refrigerator according to claim 2, wherein:

the plurality of spacers is aligned in vertical and horizontal lines; and the heat exchanger is arranged between the plurality of spacers such that the heat exchanger does not contact with each of the plurality of spacers.

4. The refrigerator according to claim 2, wherein portions other than the first end and the second end of the heat exchanger are spaced apart from the inner case and the outer case.

5. The refrigerator according to claim 4, wherein at least one portion of the heat exchanger is curved to form a longer passage than a linear distance between the first end and the second end.

6. The refrigerator according to claim 1, wherein the heat exchanger is a shell and tube heat exchanger, a pipe contact heat exchanger, or a dual pipe heat exchanger.

7. The refrigerator according to claim 1, wherein the heat exchanger comprises:

a first tube to guide the refrigerant exhausted from the evaporator toward a compressor; and a second tube to guide the refrigerant exhausted from a condenser, wherein a diameter of the first tube is larger than a diameter of the second tube.

8. The refrigerator according to claim 7, wherein a first end and a second end of the heat exchanger are welded to the inner case and the outer case, respectively.

9. The refrigerator according to claim 7, wherein a first end and a second end of the heat exchanger are welded to the inner case and the outer case, respectively, with the first tube and the second tube spaced apart from each other.

10. The refrigerator according to claim 9, wherein:

two communication holes are formed in the outer case and are spaced apart a predetermined distance from each other;

two communication holes are formed in the inner case and are spaced apart a predetermined distance from each other; and wherein the two communication holes in the outer case and the two communication holes in the inner case allow welding of the first tube and the second tube.

11. The refrigerator according to claim 10, wherein the first tube has a first end fixed through the inner case and a second end fixed through the outer case, and the second tube has a first end fixed through the inner case and a second end fixed through the outer case.

12. The refrigerator according to claim 1, wherein each of the guide structures is configured to circumscribe an outer circumference of the heat exchanger.

13. A refrigerator comprising:

an inner case in which a storage space is formed;

an outer case accommodating the inner case;

a vacuum space provided between the inner case and the outer case;

a supporting structure to maintain a distance between the inner case and the outer case, without deformation of the inner case and the outer case generated by an external shock;

a heat exchanger configured to generate heat exchange between a refrigerant that has passed an evaporator and a refrigerant that is being drawn into the evaporator; and a plurality of guide structures spaced predetermined distances apart from each other and arranged to provide structural support to position the heat exchanger apart from the inner case and the outer case, each of the plurality of guide structures being spaced apart from one another and from a first portion of the supporting structure while being in contact with a second portion of the supporting structure, wherein:

the heat exchanger is provided within the vacuum space;

both the plurality of guide structures and the supporting structure are provided within the vacuum space;

inner surfaces of the plurality of guide structures contact the heat exchanger and outer surfaces of the plurality of guide structures contact the second portion of the supporting structure comprising support plates; and the first portion of the supporting structures comprise spacers.

14. The refrigerator of the claim 13, wherein the heat exchanger is arranged not to directly contact with the supporting structure to reduce heat transfer.

15. The refrigerator of the claim 13, wherein the first portion of the supporting structure comprises a plurality of spacers extending in a direction of a thickness of the vacuum space.

16. The refrigerator of the claim 13, wherein the second portion of the supporting structure comprises a support plate extending in a direction of a length of the vacuum space.

17. The refrigerator of the claim 13, wherein the supporting structure comprises a first support plate provided in one of facing surfaces associated with the inner case and the outer case.

18. The refrigerator of the claim 17, wherein the supporting structure comprises a second support plate provided in the other one of the facing surfaces associated with the inner case and the outer case, facing the first support plate.

19. The refrigerator of the claim 13, wherein the first portion of the supporting structure comprises a plurality of spacers fixed to a first support plate to provide the space between the inner case and the outer case.

20. The refrigerator of the claim 19, wherein the second portion of the supporting structure comprises a second support plate having a plurality of grooves formed in an inner surface of the second support plate, and wherein ends of the spacers are inserted in the plurality of grooves.

21. The refrigerator of the claim 1, wherein:

at least two of the plurality of guide structures are spaced apart from each other; and the at least two of the plurality of guide structures have a shape of a disk or ring having a hole through which the heat exchanger passes.

22. The refrigerator of the claim 13, wherein:

the supporting structure comprises a spacer extending in a direction of a thickness of the vacuum space; and outer surfaces of the plurality of guide structures does not contact the spacer.

* * * * *